US010253479B2

(12) United States Patent
Kaneta et al.

(10) Patent No.: US 10,253,479 B2
(45) Date of Patent: Apr. 9, 2019

(54) HYDRAULIC SYSTEM FOR WORK MACHINE

(71) Applicants: Hitachi Construction Machinery Co., Ltd., Tokyo (JP); Takako Satake, Ishioka-shi (JP)

(72) Inventors: Tomoaki Kaneta, Kasumigaura (JP); Kouji Ishikawa, Kasumigaura (JP); Hidetoshi Satake, Ishioka (JP); Shinya Imura, Toride (JP)

(73) Assignee: Hitachi Construction Machinery Co., Ltd, Tokyo (JP)

( * ) Notice: Subject to any disclaimer, the term of this patent is extended or adjusted under 35 U.S.C. 154(b) by 97 days.

(21) Appl. No.: 14/915,311

(22) PCT Filed: Jan. 9, 2015

(86) PCT No.: PCT/JP2015/050455
§ 371 (c)(1),
(2) Date: Feb. 29, 2016

(87) PCT Pub. No.: WO2015/146219
PCT Pub. Date: Oct. 1, 2015

(65) Prior Publication Data

US 2017/0002545 A1 Jan. 5, 2017

(30) Foreign Application Priority Data

Mar. 24, 2014 (JP) ..... 2014-060890

(51) Int. Cl.
*F15B 11/08* (2006.01)
*F15B 13/04* (2006.01)
(Continued)

(52) U.S. Cl.
CPC ..... *E02F 9/2228* (2013.01); *E02F 3/963* (2013.01); *E02F 9/2012* (2013.01);
(Continued)

(58) Field of Classification Search
CPC . E02F 3/32; E02F 3/963; E02F 9/2012; E02F 9/225; E02F 9/2228; E02F 9/2267;
(Continued)

(56) References Cited

U.S. PATENT DOCUMENTS 9,200,430 B2 * 12/2015 Kawasaki ..... E02F 9/2217
9,458,840 B2 * 10/2016 Azuma ..... E02F 9/2235
(Continued)

FOREIGN PATENT DOCUMENTS

JP 06-010376 A 1/1994
JP 2007-192344 A 1/2006
(Continued)

OTHER PUBLICATIONS

International Search Report (PCT/ISA/210) issued in PCT Application No. PCT/JP2015/050455 dated Mar. 24, 2015 with English translation (5 pages).
(Continued)

*Primary Examiner* — Logan Kraft
(74) *Attorney, Agent, or Firm* — Crowell & Moring LLP

(57) ABSTRACT

When option attachment has not been attached, a reserve flow/direction control valve 8 is made to operate as a center bypass cut valve. When an option attachment has been attached, switching control is performed. In the switching control, when the option attachment is not used, the reserve flow/direction control valve 8 is made to operate as a center bypass cut valve for adjusting composite opening area of a center bypass and thereby controlling the flow rate of hydraulic fluid flowing into an actuator. When the option attachment is used, the reserve flow/direction control valve 8 is made to operate so as to supply the hydraulic fluid to an option hydraulic actuator 14.

2 Claims, 12 Drawing Sheets

(51) Int. Cl.

| | |
|---|---|
| ***E02F 3/32*** | (2006.01) |
| ***E02F 3/96*** | (2006.01) |
| ***E02F 9/20*** | (2006.01) |
| ***E02F 9/22*** | (2006.01) |

(52) U.S. Cl.
CPC ..... *E02F 9/2225* (2013.01); *E02F 9/2267* (2013.01); *E02F 9/2282* (2013.01); *E02F 9/2285* (2013.01); *E02F 9/2292* (2013.01); *E02F 9/2296* (2013.01); *F15B 11/08* (2013.01); *F15B 13/0401* (2013.01); *E02F 3/32* (2013.01); *F15B 2211/30* (2013.01); *F15B 2211/30515* (2013.01); *F15B 2211/40* (2013.01); *F15B 2211/50509* (2013.01); *F15B 2211/7135* (2013.01)

(58) Field of Classification Search
CPC ..... E02F 9/2282; E02F 9/2292; E02F 9/2296; F15B 11/08; F15B 13/0401; F15B 2211/30; F15B 2211/40; F15B 2211/7135; F15B 2211/50509; F15B 2211/30515
See application file for complete search history.

(56) References Cited

U.S. PATENT DOCUMENTS

| | | | |
|---|---|---|---|
| 2007/0169474 | A1 | 7/2007 | Oka et al. |
| 2012/0198831 | A1 | 8/2012 | Kodaka et al. |
| 2012/0291427 | A1 | 11/2012 | Azuma et al. |

FOREIGN PATENT DOCUMENTS

| | | | |
|---|---|---|---|
| JP | 2011-085198 | A | 10/2009 |
| JP | 2010-101448 | A | 5/2010 |
| JP | 2012-202142 | A | 3/2011 |
| JP | 2013-231464 | A | 4/2012 |
| KR | 10-2012-0137343 | A | 12/2012 |

OTHER PUBLICATIONS

International Preliminary Report on Patentability (PCT/IB/338 & PCT/IB/373) issued in PCT Application No. PCT/JP2015/050455 dated Oct. 6, 2016, including English translation of Japanese-language Written Opinion (PCT/ISA/237), (6 pages).
Korean-language Office Action issued in counterpart Korean Application No. 10-2016-7004088 dated Feb. 13, 2017(5 pages).

* cited by examiner

HYDRAULIC SYSTEM FOR WORK MACHINE

TECHNICAL FIELD

The present invention relates to a hydraulic system for a work machine, and in particular, to the hydraulic system for the work machine such as a hydraulic excavator in which a front work implement is operated by using a hydraulic cylinder or the like.

BACKGROUND ART

As described in Patent Document 1, a hydraulic system for a work machine such as a hydraulic excavator generally includes a hydraulic pump, a hydraulic actuator driven by hydraulic fluid delivered from the hydraulic pump, a flow/direction control valve of the center bypass type for controlling the flow of the hydraulic fluid supplied from the hydraulic pump to the hydraulic actuator, operation means provided corresponding to each hydraulic actuator to operate each flow/direction control valve, and a pump regulator that controls the displacement of the hydraulic pump in such a manner that the delivery amount of the hydraulic pump changes according to the operation on the operation means.

Some of the hydraulic systems for work machines such as hydraulic excavators include, for various purposes, a center bypass cut valve arranged at the downstream end of a center bypass line extending through the flow/direction control valve of the center bypass type. Patent Document 1 describes an example of such a hydraulic system. Specifically, when the operation means is operated so as to supply the hydraulic fluid to a cylinder chamber on the load holding side, the center bypass cut valve is operated in a direction for reducing the center bypass opening area, and the delivery pressure of the hydraulic pump is controlled to be higher than the load pressure of the cylinder. Accordingly, deterioration in the fuel efficiency is prevented through a reduction in the energy loss and excellent low-speed operability is achieved.

In recent years, there have been proposed work machines improving their energy efficiency by driving the upper swing structure by use of a hydraulic motor and an electric motor, thereby making the electric motor function as a generator at times of deceleration or stoppage of the upper swing structure, and recovering energy in the form of electric power.

For example, in a work machine described in Patent Document 2, the center bypass cut valve is formed by use of a reserve spool which normally exists in the control valve unit. When the swing electric motor is set in a non-driving state, the reserve spool is controlled so as to throttle the open center hydraulic line by use of a composite restrictor formed of a bleed-off restrictor of the flow/direction control valve and a bleed-off restrictor of the reserve spool, by which control is performed to raise the meter-in pressure of the swing hydraulic motor and thereby increase the drive torque of the swing hydraulic motor. With this control, excellent operability and work performance are secured even when the need of stopping the function of the electric motor arose due to a failure in the electric motor, a voltage abnormality in the electrical storage device, or the like.

PRIOR ART DOCUMENTS

Patent Documents

Patent Document 1: JP-2011-85198-A
Patent Document 2: JP-2012-202142-A

SUMMARY OF THE INVENTION

Problem to be Solved by the Invention

However, the hydraulic system described in Patent Document 1 needs a space and cost for the installation of the center bypass cut valve at the downstream end of the center bypass line extending through the center bypass type flow/direction control valve.

Simply applying the technology of Patent Document 2 forming the center bypass cut valve by use of the reserve spool to the technology of Patent Document 1 makes it possible to at least eliminate the need of the space and cost for the installation of the center bypass cut valve at the downstream end of the center bypass line.

However, when an attachment is attached to the work machine, a problem arises in that the reserve spool is used as a flow/direction control valve for controlling the flow of the hydraulic fluid supplied to the hydraulic actuator of the attachment and thus cannot be used as the center bypass cut valve, and the control of the center bypass opening area cannot be performed. Therefore, when an attachment has been attached to the work machine, it is impossible to prevent the deterioration in the fuel efficiency through a reduction in the energy loss, or to achieve excellent low-speed operability.

The object of the present invention is to provide a hydraulic system for a work machine capable of performing the control of the center bypass opening area even when an attachment has been attached to the work machine, without the need of providing a special-purpose center bypass cut valve.

Means for Solving the Problem

To achieve the above object, a first aspect of the present invention provides a hydraulic system for a work machine, including: a hydraulic pump; a hydraulic actuator driven by hydraulic fluid delivered from the hydraulic pump; a flow/direction control valve of center bypass type that controls a flow of the hydraulic fluid supplied from the hydraulic pump to the hydraulic actuator; a reserve flow/direction control valve of the center bypass type arranged at a position in a center bypass line extending through the flow/direction control valve and on a downstream side of the flow/direction control valve, the reserve flow/direction control valve controlling the flow of the hydraulic fluid supplied from the hydraulic pump to an option hydraulic actuator when the option hydraulic actuator is used; and a switching control device that makes the reserve flow/direction control valve operate as a valve for controlling the flow of the hydraulic fluid supplied to the option hydraulic actuator when the option hydraulic actuator is operated, while making the reserve flow/direction control valve operate as a center bypass cut valve when the option hydraulic actuator is not operated.

With this configuration, when an option attachment has been attached but is not used, the reserve flow/direction control valve can be made to operate as the center bypass cut valve similarly to the case where no option attachment has been attached. At times of heavy-load slow-operation work, the deterioration in the fuel efficiency can be prevented through a reduction in the energy loss and excellent low-speed operability can be achieved without the need of providing a special-purpose center bypass cut valve.

According to a second aspect of the present invention, in the hydraulic system according to the first aspect, the switching control device includes a switch for switching the operation of the reserve flow/direction control valve.

With this configuration, when an option attachment has been attached but is not used, it is possible to prevent the hydraulic fluid from being supplied to the option hydraulic actuator, that is, to prevent the option attachment from moving. Accordingly, operations not intended by the operator can be prevented from occurring.

According to a third aspect of the present invention, in the hydraulic system according to the first aspect, the switching control device further includes a sensor configured to detect that the hydraulic system is in a state not for making the reserve flow/direction control valve operate as a flow/direction control valve for the option hydraulic actuator. The switching control device performs the control configured to switch the operation of the reserve flow/direction control valve based on a detection signal outputted from the sensor.

With this configuration, the circuit configuration is simplified and a hydraulic system at a lower cost can be implemented. Further, the operation is also simple and easy since the function of the reserve flow/direction control valve is switched according to the operation on the option attachment.

According to a fourth or fifth aspect of the present invention, the hydraulic system according to the second or third aspect further includes a switching valve arranged in an actuator hydraulic line for supplying the hydraulic fluid from the reserve flow/direction control valve to the option hydraulic actuator. The switching control device performs the control so as to close the switching valve and thereby block the hydraulic line when the reserve flow/direction control valve is made to operate as the center bypass cut valve.

With this configuration, when an option attachment has been attached, the supply of the hydraulic fluid to the option hydraulic actuator can be blocked reliably and operations not intended by the operator can be prevented from occurring in cases where the reserve flow/direction control valve is made to operate as the center bypass cut valve.

According to a sixth aspect of the present invention, in the hydraulic system according to the first aspect, the reserve flow/direction control valve is switchable to a first position for supplying the hydraulic fluid to the option hydraulic actuator and a second position for blocking the supply of the hydraulic fluid to the option hydraulic actuator. The switching control device performs the control so as to switch the reserve flow/direction control valve to the first position when the reserve flow/direction control valve is made to operate as a valve for controlling the flow of the hydraulic fluid supplied to the option hydraulic actuator, and to the second position when the reserve flow/direction control valve is made to operate as the center bypass cut valve.

With this configuration, a hydraulic system suitable for a mode in which the hydraulic fluid is supplied only to a cylinder chamber on one side of the option hydraulic actuator can be implemented.

Effect of the Invention

According to the present invention, in cases where an option hydraulic actuator has been installed in the hydraulic system, the function of the reserve flow/direction control valve can be switched between the function of adjusting the composite opening area of the center bypass and the function of supplying the hydraulic fluid to the option hydraulic actuator. This makes it possible to perform the control of the center bypass opening area even when an attachment has been attached to the work machine, without the need of providing a special-purpose center bypass cut valve. Accordingly, the effects of preventing the deterioration in the fuel efficiency through a reduction in the energy loss and achieving excellent low-speed operability can be obtained even when an attachment has been attached to the work machine.

MODES FOR CARRYING OUT THE INVENTION

Embodiments of a hydraulic system for a work machine according to the present invention will be described below with reference to figures.

Work Machine

First, a work machine in which the hydraulic system according to the present invention is installed will be explained below with reference to FIGS. 1 and 2. The following explanation will be given of application to a hydraulic excavator as an example of the work machine.

Figure 1:
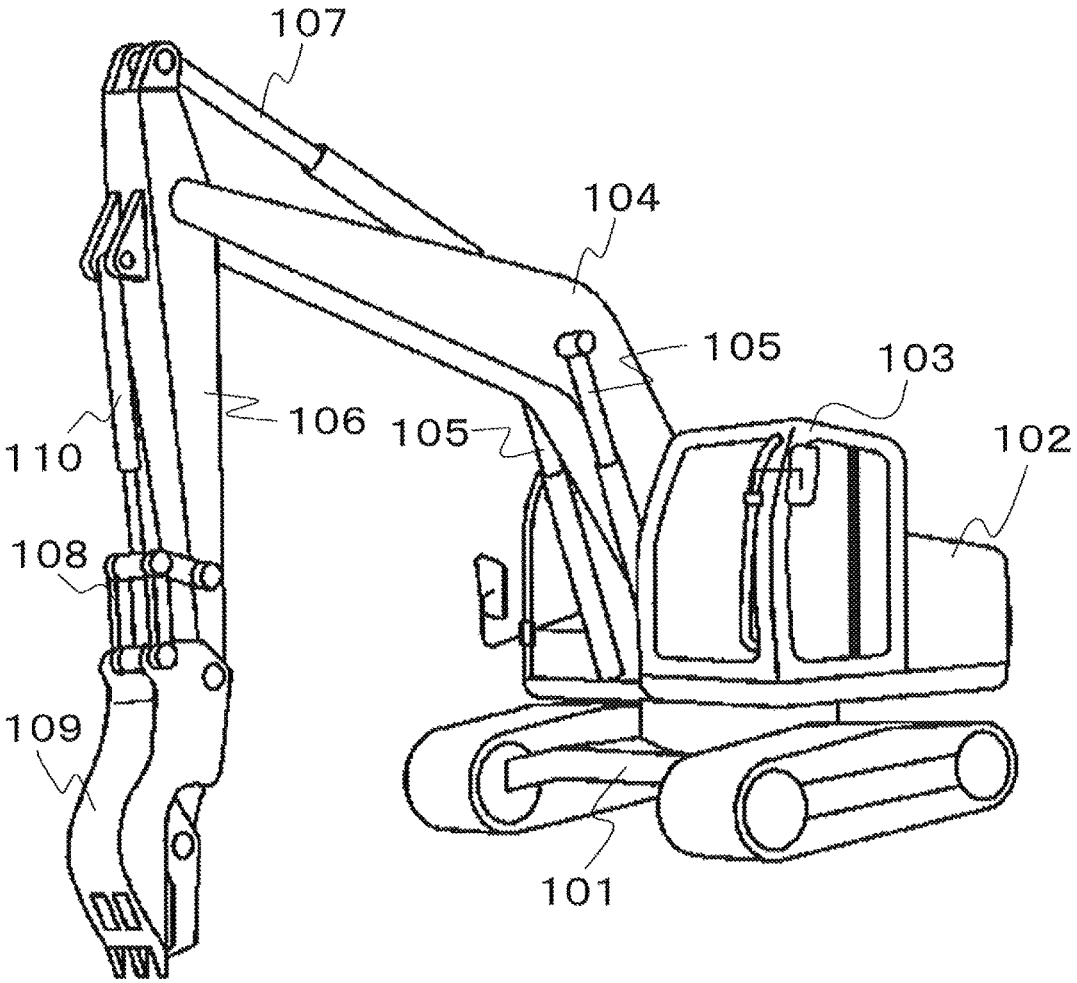
FIG. 1 is a perspective view of a hydraulic excavator.

FIG. 1 is a perspective view of the hydraulic excavator. FIG. 2 is a schematic diagram showing a crusher attached to the hydraulic excavator shown in FIG. 1, wherein part of the crusher is removed imaginarily.

As shown in FIG. 1, the work machine configured based on a hydraulic excavator includes a track structure 101 of the crawler type. A swing structure 102 is mounted on the track structure 101 to be swingable. A cab 103 is arranged in a left front part of the swing structure 102, while a boom 104 extends from a central part of the swing structure 102. The boom 104 is elevated and lowered by the expansion and contraction of a pair of boom cylinders 105 arranged at prescribed positions on both sides of the boom 104. An arm 106 is rotatably connected to the end of the boom 104. To the tip end of the arm 106, a crusher 109 as an option attachment has been attached via a link mechanism 108 instead of a bucket which was originally attached. The arm 106 and the crusher 109 are also rotated by the expansion and contraction of an arm cylinder 107 and an attachment cylinder 110, respectively. Besides the above-described components, the hydraulic excavator shown in FIG. 1 also includes functional components (unshown) necessary for achieving the functions of the hydraulic excavator.

Figure 2:
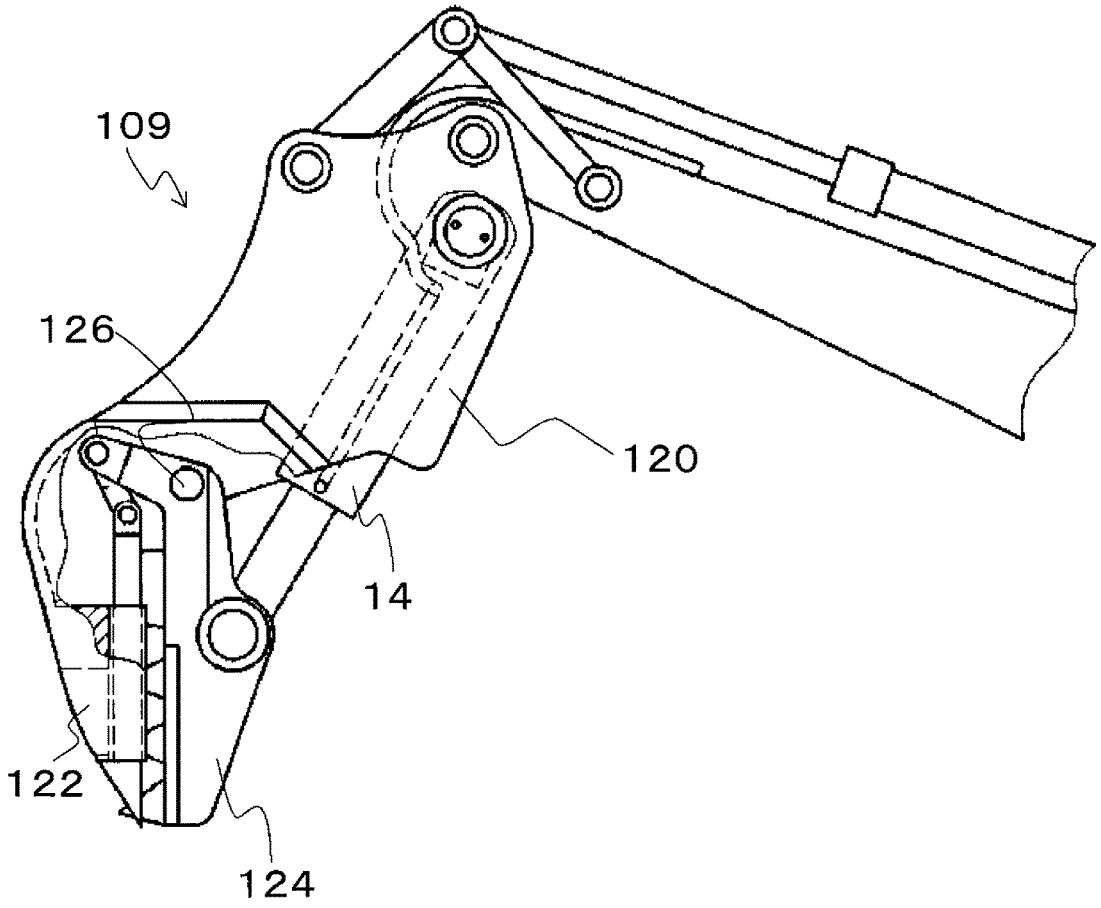
FIG. 2 is a schematic diagram showing a crusher attached to the hydraulic excavator shown in FIG. 1, wherein part of the crusher is removed imaginarily.

As shown in FIG. 2, the crusher 109 mainly includes a base frame 120, a fixed jaw 122 formed integrally with the tip end part of the base frame 120 to extend from the tip end part, and a movable jaw 124 attached to the base frame 120 to be rotatable. The opening and closing movement of the crusher 109 is implemented by the cooperation of the fixed jaw 122 and the movable jaw 124.

The movable jaw 124 is connected to a crusher cylinder (option hydraulic actuator) 14 that is arranged in the base frame 120. Upon expansion or contraction of the crusher cylinder 14, the movable jaw 124 rotates around a rotary shaft 126 and implements the opening and closing movement of the crusher 109.

First Embodiment

Next, a first embodiment of the hydraulic system for a work machine according to the present invention will be described below with reference to FIGS. 3-8.

Figure 3:
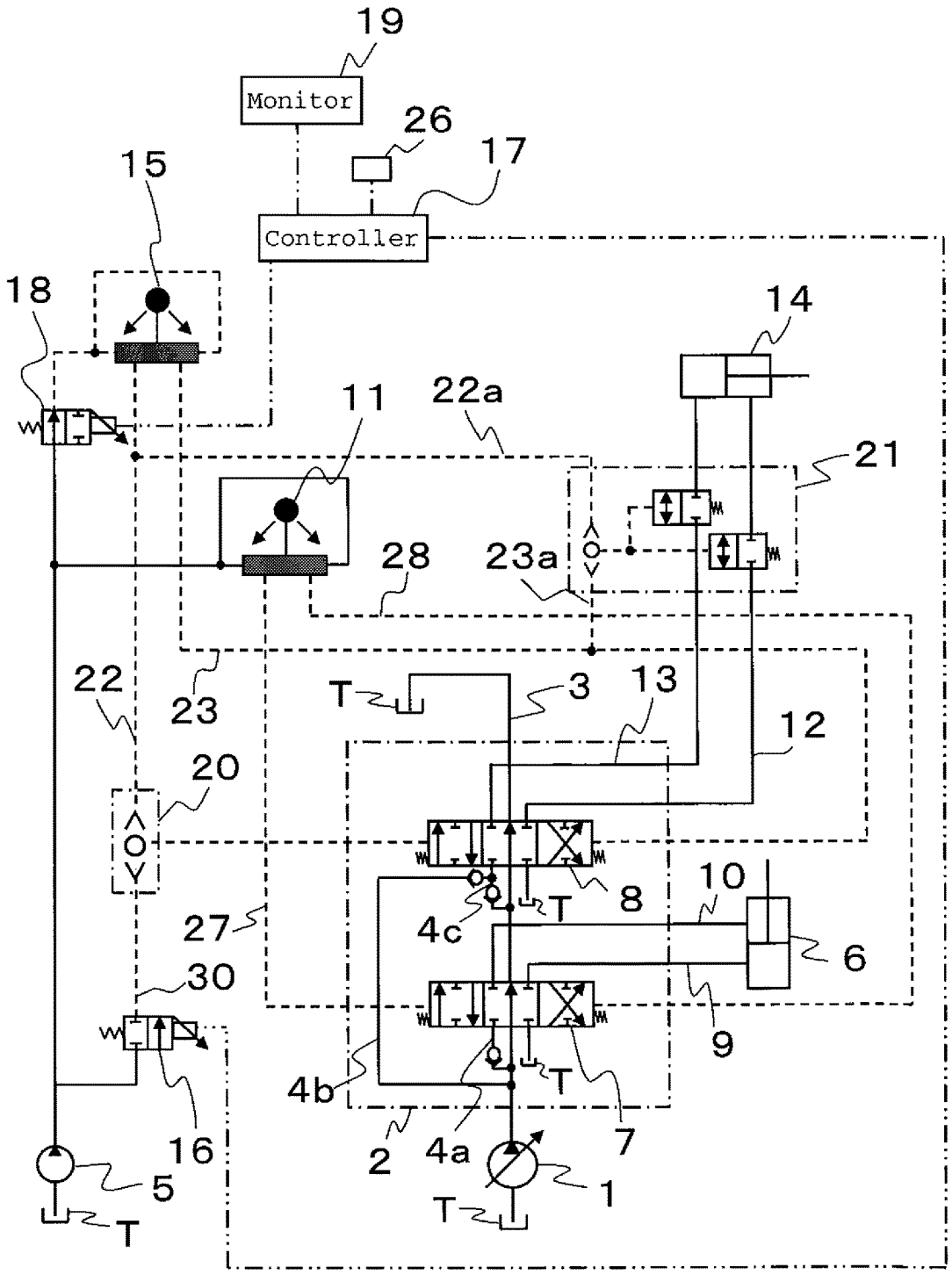
FIG. 3 is a configuration diagram showing the outline of a first embodiment of a hydraulic system for a work machine according to the present invention.
Figure 4:
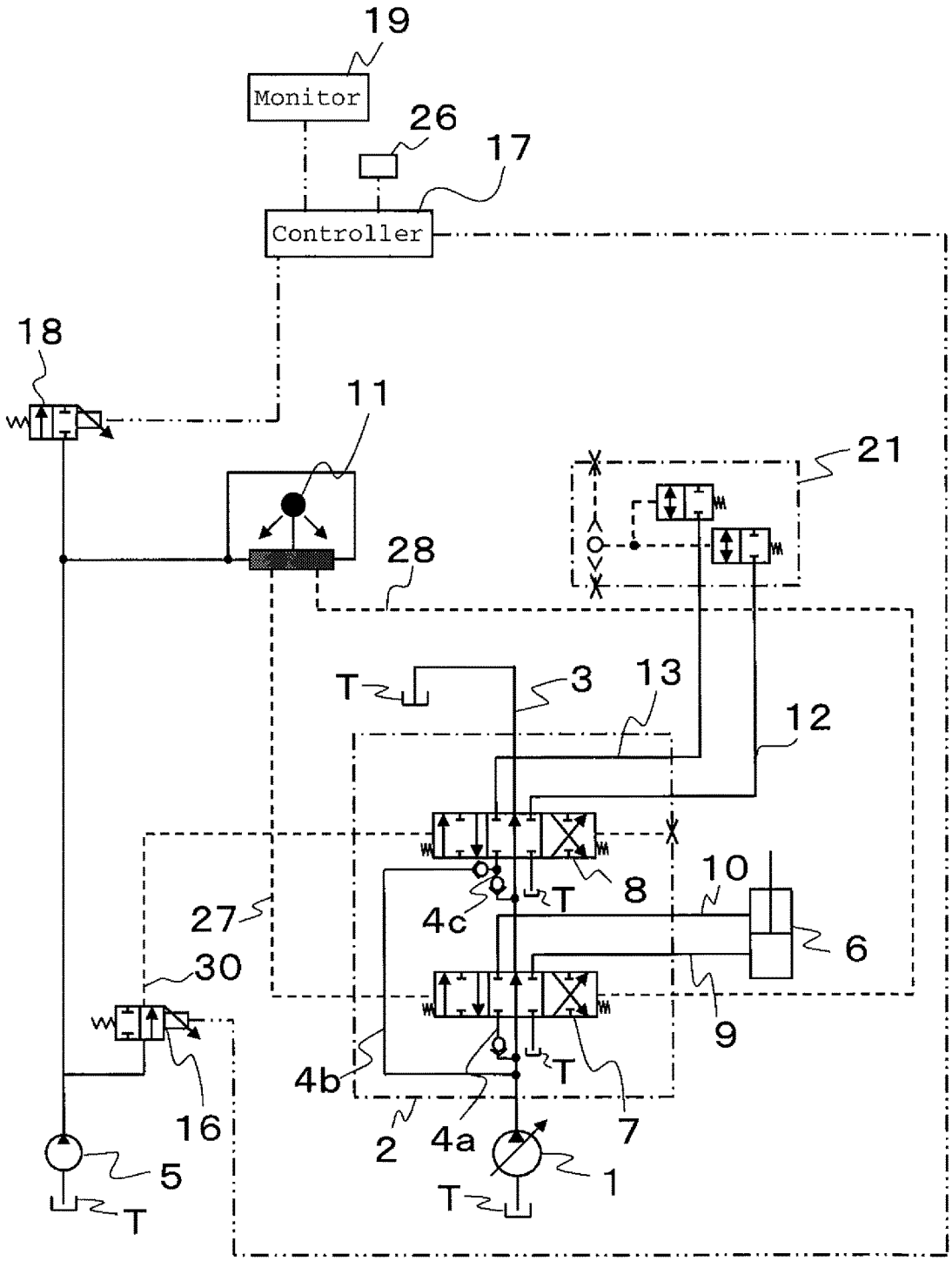
FIG. 4 is a configuration diagram showing the outline of a circuit configuration in the first embodiment of the hydraulic system for a work machine according to the present invention when no option attachment has been attached.
Figure 5:
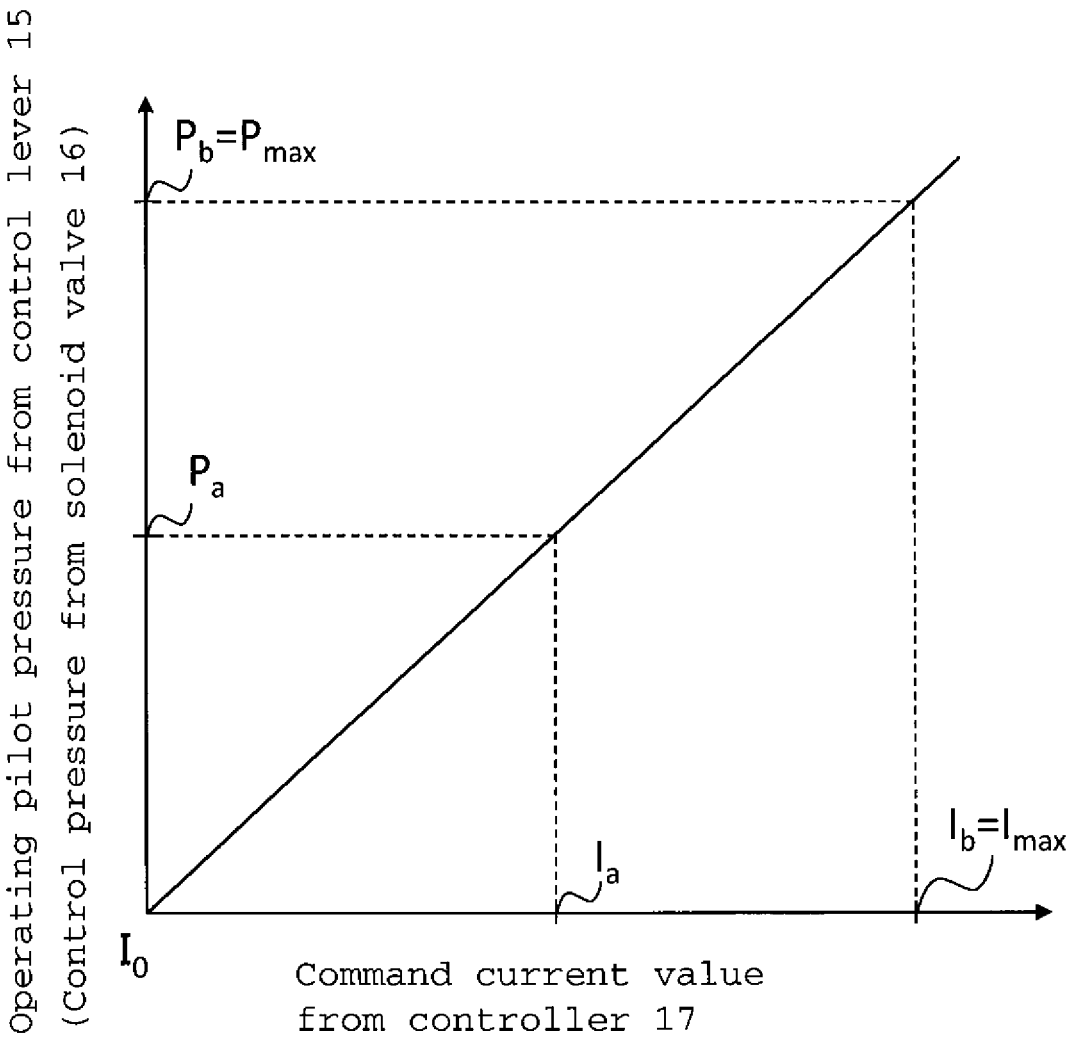
FIG. 5 is a graph showing an example of the relationship between a command current value from a controller and control pilot pressure that is inputted to a reserve flow/direction control valve in the first embodiment of the present invention.
Figure 6:
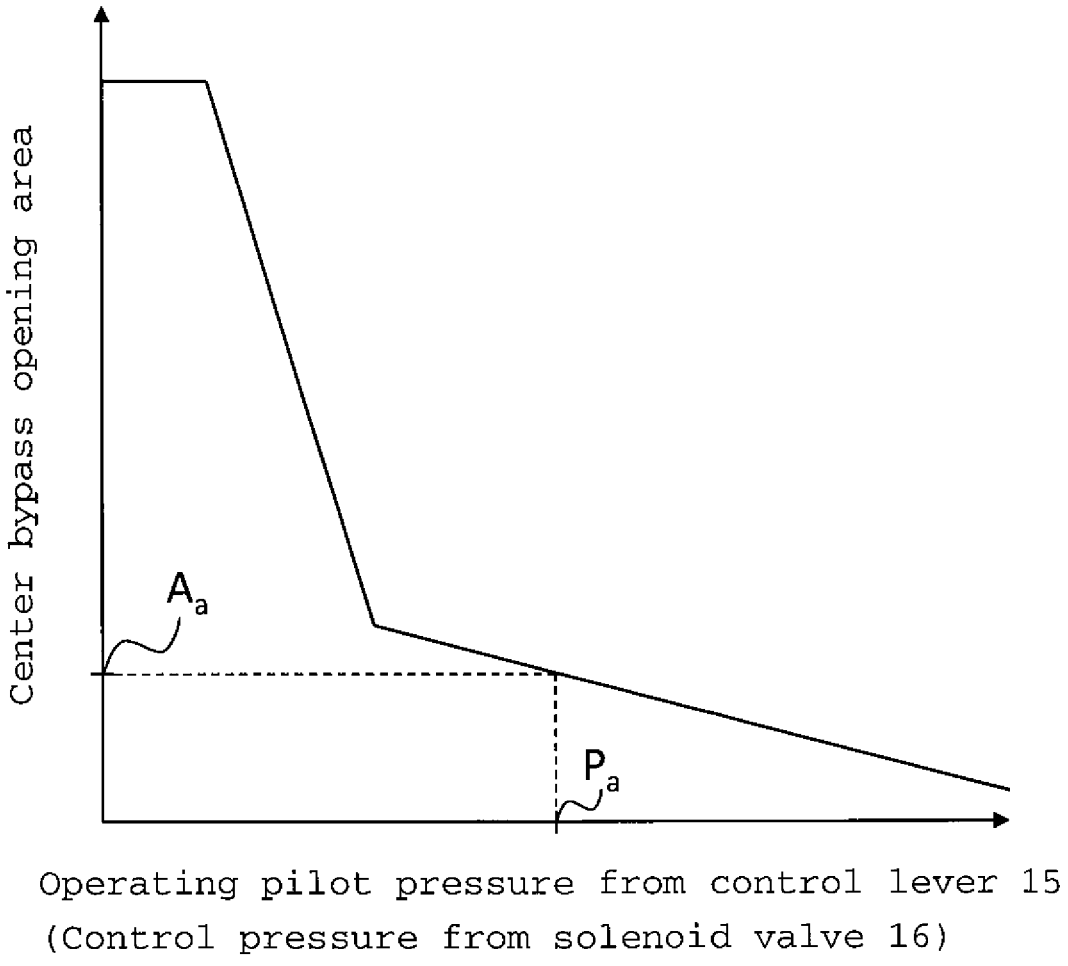
FIG. 6 is a graph showing an example of an opening area characteristic of the flow/direction control valve in the first embodiment of the present invention.
Figure 7:
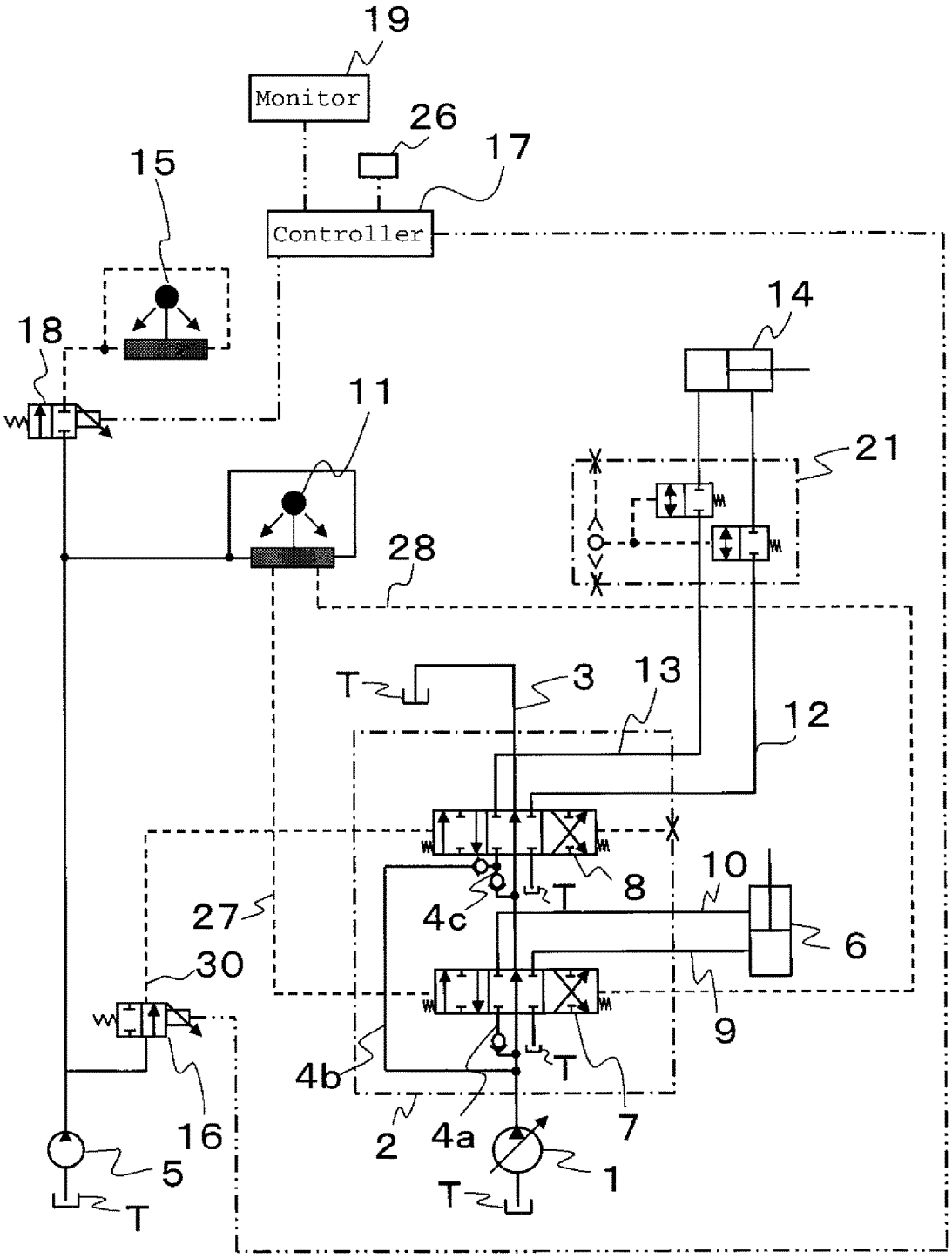
FIG. 7 is a configuration diagram showing the outline of a circuit configuration in the first embodiment of the hydraulic system for a work machine according to the present invention when an option attachment has been attached.
Figure 8:
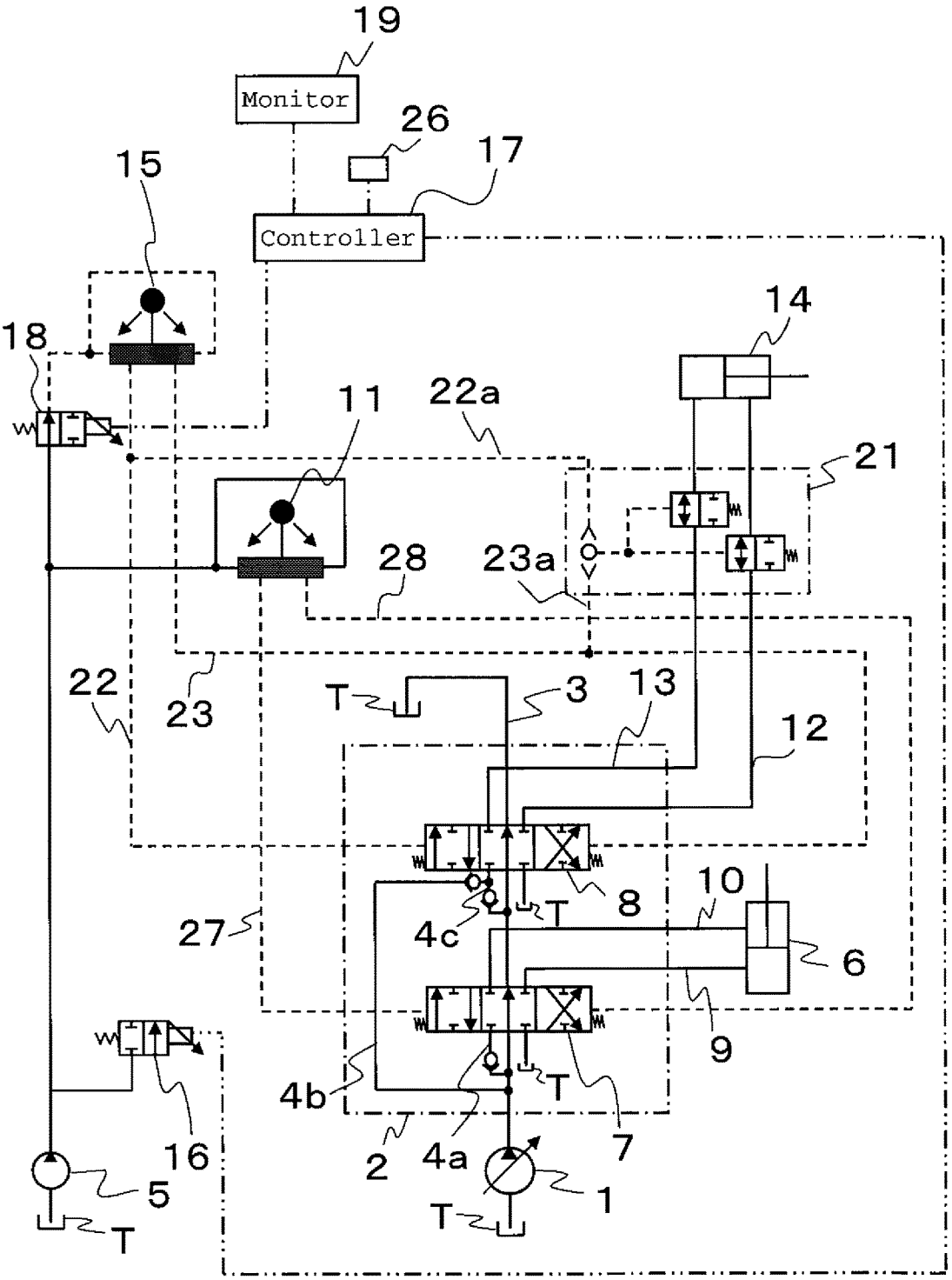
FIG. 8 is a configuration diagram showing the outline of a circuit configuration in the first embodiment of the hydraulic system for a work machine according to the present invention when an option attachment has been attached.

FIG. 3 is a configuration diagram showing the outline of the first embodiment of the hydraulic system for a work machine according to the present invention. FIG. 4 is a configuration diagram showing the outline of a circuit configuration in the first embodiment of the hydraulic system for a work machine according to the present invention when no option attachment has been attached. FIG. 5 is a graph showing an example of the relationship between a command current value from a controller and control pilot pressure that is inputted to a reserve flow/direction control valve in the first embodiment of the present invention. FIG. 6 is a graph showing an example of an opening area characteristic of the flow/direction control valve in the first embodiment of the present invention. FIG. 7 is a configuration diagram showing the outline of a circuit configuration in the first embodiment of the hydraulic system for a work machine according to the present invention when an option attachment has been attached. FIG. 8 is a configuration diagram showing the outline of a circuit configuration in the first embodiment of the hydraulic system for a work machine according to the present invention when an option attachment has been attached.

In FIG. 3, solid lines represent hydraulic lines for hydraulic fluid delivered from a pump, broken lines represent hydraulic lines for transmitting pilot pressures, one-dot broken lines represent valves for controlling the flow rate and the direction of the hydraulic fluid, and two-dot broken lines represent signal paths from the controller. The same applies to FIGS. 4, 7, 8, 9, 10, 11 and 12.

In FIG. 3, the hydraulic system for a work machine includes a hydraulic pump 1, a pilot pump 5, and a hydraulic actuator 6 and an option hydraulic actuator 14 that are driven by the hydraulic fluid delivered from the hydraulic pump 1.

The hydraulic pump 1 is a variable displacement hydraulic pump (main pump) driven by an engine. The hydraulic pump 1 and the pilot pump 5 are driven and rotated by the engine and deliver the hydraulic fluid.

The hydraulic system shown in FIG. 3 further includes a control valve 2 that controls the flow (i.e., the direction and the flow rate) of the hydraulic fluid supplied from the hydraulic pump 1 to the hydraulic actuator 6 and the option hydraulic actuator 14 and thereby controls the driving of the hydraulic actuator 6 and the option hydraulic actuator 14.

The control valve 2 includes a flow/direction control valve 7 that controls the flow rate and the direction of the hydraulic fluid supplied from the hydraulic pump 1 to the hydraulic actuator 6 and a reserve flow/direction control valve 8 that controls the flow rate and the direction of the hydraulic fluid supplied from the hydraulic pump 1 to the option hydraulic actuator 14. The control valve 2 controls the flow rates and the directions of the hydraulic fluid supplied to the hydraulic actuator 6 and the option hydraulic actuator 14 by driving the flow/direction control valves 7 and 8 according to pilot pressures supplied from an actuator control lever 11 and an option hydraulic actuator control lever 15 of the lever-operation type.

The flow/direction control valve 7 and the reserve flow/direction control valve 8, as flow/direction control valves of the center bypass type, are arranged in a center bypass line 3. In other words, the center bypass line 3 extends through the flow/direction control valve 7 and the reserve flow/direction control valve 8. The upstream end of the center bypass line 3 is connected to the hydraulic pump 1, while the downstream end of the center bypass line 3 is connected to a tank T. The flow/direction control valve 7 and the reserve flow/direction control valve 8 are also connected in parallel to the center bypass line 3 via a hydraulic parallel line **4*b***.

The flow/direction control valve 7 at its neutral position blocks first actuator lines 9 and 10 and thereby returns the hydraulic fluid delivered from the hydraulic pump 1 to the tank T. To cause the hydraulic actuator 6 to operate, the flow/direction control valve 7 blocks the center bypass line 3, connects one of the first actuator lines 9 and 10 to a hydraulic input line **4*a* and thereby supplies the hydraulic fluid delivered from the hydraulic pump 1 to one of the bottom-side cylinder chamber and the rod-side cylinder chamber of the hydraulic actuator 6, while connecting the other one of the first actuator lines 9 and 10** to the tank T and thereby returning the hydraulic fluid discharged from the other one of the bottom-side cylinder chamber and the rod-side cylinder chamber to the tank T.

The reserve flow/direction control valve 8 at its neutral position blocks second actuator lines 12 and 13 and thereby returns the hydraulic fluid delivered from the hydraulic pump 1 to the tank T. To cause the option hydraulic actuator 14 to operate, the reserve flow/direction control valve 8 blocks the center bypass line 3, connects one of the second actuator lines 12 and 13 to a hydraulic input line **4*c* and thereby supplies the hydraulic fluid delivered from the hydraulic pump 1 to one of the bottom-side cylinder chamber and the rod-side cylinder chamber of the option hydraulic actuator 14, while connecting the other one of the second actuator lines 12 and 13** to the tank T and thereby returning the hydraulic fluid discharged from the other one of the bottom-side cylinder chamber and the rod-side cylinder chamber to the tank T.

The hydraulic actuator 6 is a single rod cylinder of the double action type that is driven by the hydraulic fluid delivered from the hydraulic pump 1 in order to elevate/lower (or push/pull) the front work implement of the hydraulic excavator. The hydraulic actuator 6 collectively represents the boom cylinders 105, the arm cylinder 107, etc. shown in FIG. 1. While the control valve 2 actually includes multiple hydraulic actuators 6 and multiple flow/direction control valves 7, only one hydraulic actuator 6 and only one flow/direction control valve are shown in FIG. 3 for the simplicity of illustration.

The hydraulic actuator 6 has two cylinder chambers: the bottom-side cylinder chamber and the rod-side cylinder chamber. The bottom-side cylinder chamber is connected to the flow/direction control valve 7 via the first actuator line 9, while the rod-side cylinder chamber is connected to the flow/direction control valve 7 via the first actuator line 10.

The actuator control lever 11 includes a pressure-reducing valve that reduces the pressure of the hydraulic fluid supplied from the pilot pump 5 according to the operation amount of the lever. The actuator control lever 11 outputs a pilot pressure corresponding to the lever operation amount to the flow/direction control valve 7 via pilot hydraulic lines 27 and 28. Accordingly, the hydraulic fluid delivered from the hydraulic pump 1 is supplied to the hydraulic actuator 6 via the flow/direction control valve 7.

The option hydraulic actuator 14 is a cylinder that is not used normally but is used at times of driving an option attachment such as the crusher 109 shown in FIG. 2, a raker, or a pulverizer. The option hydraulic actuator 14 also has two cylinder chambers: the bottom-side cylinder chamber and the rod-side cylinder chamber. The rod-side cylinder chamber is connected to the reserve flow/direction control valve 8 via the second actuator line 12, while the bottom-side cylinder chamber is connected to the reserve flow/direction control valve 8 via the second actuator line 13.

The option hydraulic actuator control lever 15 includes a pressure-reducing valve that reduces the pressure supplied from the pilot pump 5 according to the operation amount of the lever. The option hydraulic actuator control lever 15 outputs a pilot pressure corresponding to the lever operation amount to the reserve flow/direction control valve 8 via pilot hydraulic lines 22 and 23.

The pilot hydraulic line 22 is equipped with a shuttle valve 20 for selecting one pilot pressure from the pilot pressure corresponding to the lever operation amount of the option hydraulic actuator control lever 15 and pilot pressure of pilot hydraulic fluid in a pilot hydraulic line 30 which has been reduced by a solenoid valve 16 according to a command current from a controller 17 and supplying the selected pilot pressure to one pressure-receiving part of the reserve flow/direction control valve 8.

The hydraulic system further includes hydraulic lines 22*a* and 23*a* branching from the pilot hydraulic lines 22 and 23, respectively. The hydraulic lines 22*a* and 23*a* are used for selecting the pilot hydraulic fluid outputted to the pilot hydraulic line 22 or the pilot hydraulic fluid outputted to the pilot hydraulic line 23 and supplying the selected pilot hydraulic fluid to an option hydraulic actuator fluid cut valve 21 when the option hydraulic actuator control lever 15 is operated.

The option hydraulic actuator fluid cut valve 21 is arranged so as to cut the flow of the hydraulic fluid in the second actuator lines 12 and 13. When the option hydraulic actuator control lever 15 is operated, the option hydraulic actuator fluid cut valve 21 switches to an open position and the hydraulic fluid delivered from the hydraulic pump 1 is supplied to the option hydraulic actuator 14 via the reserve flow/direction control valve 8.

As above, normally, the option hydraulic actuator fluid cut valve 21 is positioned at a closed position, and thus the flow of the hydraulic fluid in the second actuator lines 12 and 13 is blocked, that is, no hydraulic fluid is supplied to the option hydraulic actuator 14. In contrast, when the option hydraulic actuator control lever 15 is operated, the option hydraulic actuator fluid cut valve 21 switches to the open position and the hydraulic fluid delivered from the hydraulic pump 1 is supplied to the option hydraulic actuator 14 via the reserve flow/direction control valve 8.

A solenoid valve 18 is a pilot pressure cut solenoid valve for operating the option attachment, configured to block the hydraulic fluid supplied to the option hydraulic actuator control lever 15 according to the value of a command current from the controller 17 when no option attachment has been attached or when an option attachment has been attached but is not operated.

Similarly, the solenoid valve 16 is a solenoid valve for driving the reserve flow/direction control valve, configured to make the reserve flow/direction control valve 8 operate as a center bypass cut valve when no option attachment has been attached or when an option attachment has been attached but is not operated. For this purpose, the solenoid valve 16, whose open area is controlled according to the value of the command current from the controller 17, decompresses the hydraulic fluid delivered from the pilot pump 5, supplies the decompressed hydraulic fluid to the pilot hydraulic line 22 via the pilot hydraulic line 30 and the shuttle valve 20, and supplies the decompressed hydraulic fluid to one pressure-receiving part of the reserve flow/direction control valve 8.

The controller 17 performs control so as to make the reserve flow/direction control valve 8 operate as the center bypass cut valve when no option attachment, e.g., the crusher 109, has been attached. The controller 17 also performs switching control based on a command at a switch 26, which is used for specifying whether the option attachment should be operated or not, when the option attachment such as the crusher 109 has been attached. In the switching control, when the option attachment is operated, the controller 17 makes the reserve flow/direction control valve 8 operate as a valve for controlling the flow of the hydraulic fluid supplied to the option hydraulic actuator 14. When the option attachment is not operated, the controller 17 makes the reserve flow/direction control valve 8 operate as the center bypass cut valve.

The switch 26, which is used for the aforementioned switching for making the reserve flow/direction control valve 8 operate as the valve for controlling the flow of the hydraulic fluid supplied to the option hydraulic actuator 14 when the option attachment is operated or as the center bypass cut valve when the option attachment is not operated, is arranged in the cab 103.

A monitor 19 is configured to display a selection screen to let the operator select whether the option attachment such as the crusher 109 is currently attached to the hydraulic excavator or not. The monitor 19 also displays a screen for indicating whether the reserve flow/direction control valve 8 is currently operating with the function of supplying the hydraulic fluid to the option hydraulic actuator 14 or the function as the center bypass cut valve.

Operation

Next, the operation of the above-described hydraulic system for a work machine according to the first embodiment will be explained below with reference to FIGS. 4-8.

Option Attachment not Attached

FIG. 4 is a configuration diagram showing the outline of the circuit configuration of the hydraulic system for a work machine according to this embodiment when no option attachment has been attached.

In the hydraulic excavator shown in FIG. 1, when a selection of a mode in which not the option attachment but the bucket has been attached is made through a selection part of the monitor 19 or the like, the controller 17 outputs a command current to the solenoid valve 18 to cause the solenoid valve 18 to fully close as shown in FIG. 4. In this state in which the solenoid valve 18 is fully closed, no hydraulic fluid is supplied to the option hydraulic actuator control lever 15. Therefore, no pressure rise occurs in the pilot hydraulic line 22 or 23 even if the option hydraulic actuator control lever 15 is operated by any chance. Accordingly, the option hydraulic actuator fluid cut valve 21 remains at the closed position and no hydraulic fluid is supplied to the second actuator line 12 or 13.

Further, the controller 17 outputs a command current corresponding to the operation amount of the actuator control lever 11 to the solenoid valve 16. The opening area of the solenoid valve 16 is controlled by the input of the command current. FIG. 5 shows the characteristics of the command current from the controller 17 and the pilot pressure in this case. Accordingly, the pilot hydraulic fluid delivered from the pilot pump 5 and decompressed by the solenoid valve 16 is supplied to one pressure-receiving part of the reserve flow/direction control valve 8 via the pilot hydraulic lines 30 and 22 so as to block the center bypass line 3, and the opening area of the reserve flow/direction control valve 8 in the center bypass line 3 is controlled. In this case, the opening area of the reserve flow/direction control valve 8 in the center bypass line 3 changes as shown in FIG. 6 in response to the control pilot pressure transmitted through the solenoid valve 16.

Thus, when the operator in the cab 103 operates the actuator control lever 11, the flow/direction control valve 7 operates according to the operation amount of the actuator control lever 11 and the hydraulic fluid delivered from the hydraulic pump 1 is supplied to the hydraulic actuator 6. Further, the pilot hydraulic fluid delivered from the pilot pump 5 and decompressed by the solenoid valve 16 according to the value of the command current from the controller 17 is supplied to the pilot hydraulic line 22 via the pilot hydraulic line 30 and the shuttle valve 20 and is inputted to the reserve flow/direction control valve 8. Accordingly, the reserve flow/direction control valve 8 operates and the opening area for the hydraulic line for the hydraulic fluid delivered from the hydraulic pump 1 and flowing toward the tank T via the center bypass line 3 becomes equal to the composite opening area of the flow/direction control valves 7 and 8 and is controlled to be smaller than that in cases where only the flow/direction control valve 7 operates.

Therefore, when the operator in the cab 103 operates the actuator control lever 11, the flow/direction control valve 7 operates according to the operation amount of the actuator control lever 11 and the actuator operates accordingly.

Option Attachment Attached but not Used

FIG. 7 is a configuration diagram showing the outline of the circuit configuration of the hydraulic system for a work machine according to this embodiment when an option attachment has been attached but the mode of not using the option attachment has been selected through the switch 26.

In the hydraulic excavator shown in FIG. 1, when a selection of a mode in which not the bucket but the option attachment has been attached is made through the selection part of the monitor 19 and not using the option attachment is selected through the switch 26, the controller 17 outputs a command current to the solenoid valve 18 to cause the solenoid valve 18 to fully close similarly to the aforementioned case where no option attachment has been attached. Thus, as shown in FIG. 7, the circuit configuration becomes roughly the same as that shown in FIG. 4.

Further, similarly to the case where no option attachment has been attached, the controller 17 outputs a command current corresponding to the operation amount of the actuator control lever 11 to the solenoid valve 16. By the input of the command current, the opening area of the solenoid valve 16 is controlled and the center bypass opening area of the reserve flow/direction control valve 8 is also controlled.

Option Attachment Attached and Used

FIG. 8 is a configuration diagram showing the outline of the circuit configuration of the hydraulic system for a work machine according to this embodiment when an option attachment has been attached and the mode of using the option attachment has been selected through the switch 26.

In the hydraulic excavator shown in FIG. 1, when a selection of the mode in which not the bucket but the option attachment has been attached is made through the selection part of the monitor 19 and using the option attachment is selected through the switch 26, the controller 17 outputs no command current to the solenoid valve 18 or the solenoid valve 16 as shown in FIG. 8.

Therefore, when the actuator control lever 11 is operated, the flow/direction control valve 7 operates according to the operation amount of the actuator control lever 11 and the hydraulic fluid delivered from the hydraulic pump 1 is supplied to the hydraulic actuator 6.

Meanwhile, since the solenoid valve 18 is open, the hydraulic fluid delivered from the pilot pump 5 is supplied to the option hydraulic actuator control lever 15. Thus, upon an operation on the option hydraulic actuator control lever 15, pressure rises in the pilot hydraulic line 22 or the pilot hydraulic line 23, the option hydraulic actuator fluid cut valve 21 shifts to an open state corresponding to the pressure in the pilot hydraulic line 22 or the pilot hydraulic line 23, the hydraulic fluid is supplied to the second actuator lines 12 and 13, and the supply of the hydraulic fluid to the option hydraulic actuator 14 becomes possible.

Further, since the solenoid valve 16 remains at the closed position, the pilot hydraulic fluid supplied to the pilot hydraulic line 22 flows through the shuttle valve 20 and is supplied to a pressure-receiving part of the reserve flow/direction control valve 8, the pilot hydraulic fluid supplied to the pilot hydraulic line 23 is supplied to the other pressure-receiving part of the reserve flow/direction control valve 8, and consequently, the reserve flow/direction control valve 8 operates as a valve for controlling the flow rate and the direction of the hydraulic fluid supplied to the option hydraulic actuator 14.

Therefore, when the option hydraulic actuator control lever 15 is operated, the reserve flow/direction control valve 8 operates according to the operation amount of the option hydraulic actuator control lever 15, and the hydraulic fluid delivered from the hydraulic pump 1 is supplied also to the option hydraulic actuator 14.

Effect

In the hydraulic system for a work machine according to the first embodiment which operates as described above, when no option attachment has been attached, the reserve flow/direction control valve 8 can be made to operate as the center bypass cut valve. Therefore, at times of heavy-load slow-operation work, for example, excellent low-speed operability can be achieved by making the reserve flow/direction control valve 8 operate as the center bypass cut valve and thereby controlling the delivery pressure of the hydraulic pump 1 to be higher than the load pressure of the cylinder when the control lever is operated so as to supply the hydraulic fluid to the hydraulic actuator 6's cylinder chamber on the load holding side.

When an option attachment has been attached, the switching control is conducted by switching to the configuration shown in FIG. 7 when the option attachment is not used and to the configuration shown in FIG. 8 when the option attachment is used, and the reserve flow/direction control valve 8 is switched between the function of operating as the center bypass cut valve for adjusting the composite opening area of the center bypass and thereby controlling the flow rate of the hydraulic fluid flowing into the actuator and the function of operating so as to supply the hydraulic fluid to the option hydraulic actuator 14.

Thus, when an option attachment has been attached but is not used, the reserve flow/direction control valve 8 can be made to operate as the center bypass cut valve similarly to the case where no option attachment has been attached. Accordingly, at times of heavy-load slow-operation work, advantageous effects can be achieved in that the deterioration in the fuel efficiency can be prevented through a reduction in the energy loss and excellent low-speed operability can be achieved without the need of providing a special-purpose center bypass cut valve. When an option attachment has been attached and is used, the reserve flow/direction control valve 8 can be made to operate so as to supply the hydraulic fluid to the option hydraulic actuator 14, which makes it possible to control the flow rate of the hydraulic fluid flowing into the option hydraulic actuator 14 and to use the option attachment with excellent operability.

Therefore, with the hydraulic system for a work machine according to this embodiment, the reserve flow/direction control valve 8 can be made to operate as the center bypass cut valve for adjusting the composite opening area of the center bypass even when the option attachment has been attached, and the space and cost for the installation of the center bypass cut valve can be saved.

Further, since the controller 17 is equipped with the switch 26 regarding whether the option attachment, e.g., crusher 109, should be operated or not in cases where the option attachment has been attached, it is possible to prevent the hydraulic fluid from being supplied to the option hydraulic actuator 14, i.e., prevent the option attachment from moving, even if the option hydraulic actuator control lever 15 is operated accidentally when the option attachment is not used. Accordingly, operations not intended by the operator can be prevented from occurring.

Furthermore, due to the option hydraulic actuator fluid cut valve 21 for cutting the flow of the hydraulic fluid in the second actuator lines 12 and 13, the supply of the hydraulic fluid to the option hydraulic actuator 14 can be blocked reliably and operations not intended by the operator can be prevented from occurring in cases where the reserve flow/direction control valve 8 is made to operate as the center bypass cut valve when the option attachment has been attached.

Another Mode of First Embodiment

The hydraulic system for a work machine according to this embodiment is not limited to the above-described configuration. In the following, the outline of another mode of the first embodiment of the hydraulic system for a work machine according to the present invention will be described with reference to FIG. 9.

Figure 9:
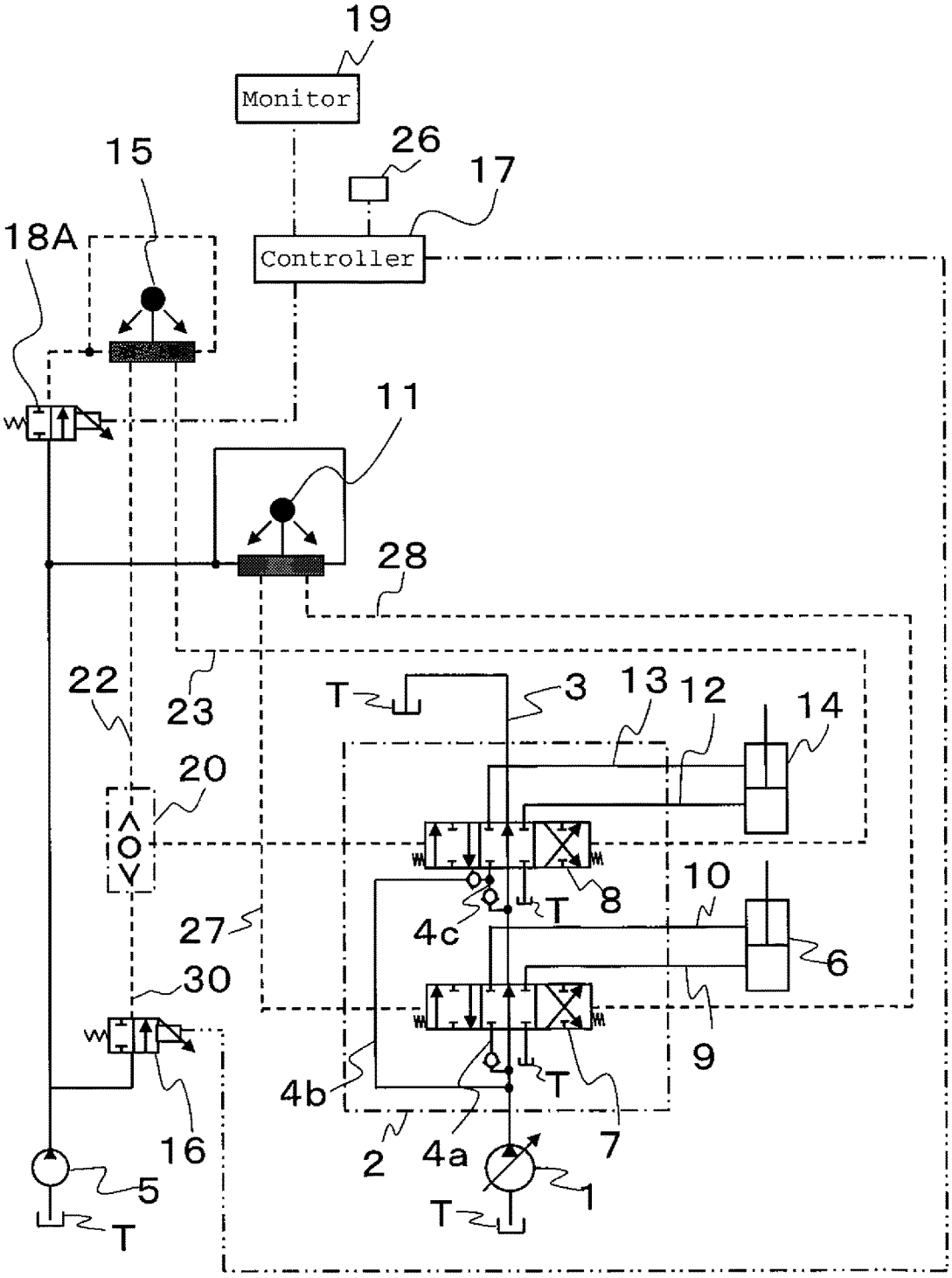
FIG. 9 is a configuration diagram showing another example of the outline of the first embodiment of the hydraulic system for a work machine according to the present invention.

FIG. 9 is a configuration diagram showing another example of the outline of the first embodiment of the hydraulic system for a work machine according to the present invention.

As shown in FIG. 9, the hydraulic system for a work machine according to another mode of the first embodiment of the present invention does not include the option hydraulic actuator fluid cut valve 21 or the hydraulic lines 22*a* and 23*a* branching respectively from the pilot hydraulic lines 22 and 23.

Further, instead of the solenoid valve 18 in the hydraulic system for a work machine according to the first embodiment shown in FIG. 3, the hydraulic system shown in FIG. 9 includes a solenoid valve 18A that is configured to supply the hydraulic fluid to the option hydraulic actuator control lever 15 according to the value of the command current from the controller 17 in cases where the option attachment has been attached and is operated.

The rest of the configuration is roughly the same as that of the hydraulic system for a work machine shown in FIG. 3.

Operation

Next, the operation of the above-described hydraulic system for a work machine according to another mode of the first embodiment will be described below.

Option Attachment not Attached

In the hydraulic excavator shown in FIG. 1, when a selection of the mode in which not the option attachment but the bucket has been attached is made through the selection part of the monitor 19, the controller 17 outputs a command current corresponding to the operation amount of the actuator control lever 11 to the solenoid valve 16. By the input of the command current, the opening area of the solenoid valve 16 is controlled and the center bypass opening area of the reserve flow/direction control valve 8 is also controlled.

In contrast, the controller 17 outputs no command current to the solenoid valve 18A. Therefore, the solenoid valve 18A fully closes, no hydraulic fluid is supplied to the option hydraulic actuator control lever 15, and no pressure rise occurs in the pilot hydraulic line 22 or 23.

Accordingly, when the operator in the cab 103 operates the actuator control lever 11, the flow/direction control valve 7 operates according to the operation amount of the actuator control lever 11 and the hydraulic fluid delivered from the hydraulic pump 1 is supplied to the hydraulic actuator 6. In this case, the reserve flow/direction control valve 8 operates and the opening area for the hydraulic line for the hydraulic fluid delivered from the hydraulic pump 1 and flowing toward the tank T via the center bypass line 3 becomes equal to the composite opening area of the flow/direction control valves 7 and 8 and is controlled to be smaller than that in cases where only the flow/direction control valve 7 operates.

Option Attachment Attached and not Used

In the hydraulic excavator shown in FIG. 1, when a selection of the mode in which not the bucket but the option attachment has been attached is made through the selection part of the monitor 19 and not using the option attachment is selected through the switch 26, the controller 17 outputs a command current corresponding to the operation amount of the actuator control lever 11 to the solenoid valve 16 while outputting no command current to the solenoid valve 18A similarly to the aforementioned case where no option attachment has been attached. Therefore, the circuit configuration becomes equivalent to that in the case where no option attachment has been attached and similar operations are made possible.

Option Attachment Attached and Used

In the hydraulic excavator shown in FIG. 1, when a selection of the mode in which not the bucket but the option attachment has been attached is made through the selection part of the monitor 19 and using the option attachment is selected through the switch 26, the controller 17 outputs a command current to the solenoid valve 18A while outputting no command current to the solenoid valve 16.

Accordingly, the solenoid valve 18A is positioned at the open position and the solenoid valve 16 is positioned at the closed position, the pilot hydraulic fluid supplied to the pilot hydraulic line 22 flows through the shuttle valve 20 and is supplied to a pressure-receiving part of the reserve flow/direction control valve 8, the pilot hydraulic fluid supplied to the pilot hydraulic line 23 is supplied to the other pressure-receiving part of the reserve flow/direction control valve 8, and the reserve flow/direction control valve 8 operates as a valve for controlling the flow rate and the direction of the hydraulic fluid supplied to the option hydraulic actuator 14.

Therefore, when the actuator control lever 11 is operated, the flow/direction control valve 7 operates according to the operation amount of the actuator control lever 11 and the hydraulic fluid delivered from the hydraulic pump 1 is supplied to the hydraulic actuator 6. When the option hydraulic actuator control lever 15 is operated, the reserve flow/direction control valve 8 operates according to the operation amount of the option hydraulic actuator control lever 15, the hydraulic fluid delivered from the hydraulic pump 1 is supplied to the option hydraulic actuator 14, and the option attachment operates.

Effect

As described above, effects similar to those of the hydraulic system for a work machine according to the first embodiment shown in FIG. 3 are achieved also in the hydraulic system for a work machine according to another mode of the first embodiment shown in FIG. 9.

Further, since the hydraulic system for a work machine in this mode does not include the option hydraulic actuator fluid cut valve 21 or the hydraulic lines 22*a* and 23*a* branching from the pilot hydraulic lines 22 and 23, the circuit configuration becomes simple compared to the hydraulic system for a work machine shown in FIG. 3 and a low-cost hydraulic system can be implemented.

Incidentally, while hydraulic systems having the switch 26 have been described in the above embodiment, it is also possible to configure the selection part of the monitor 19 to receive commands for the switching of the current function of the reserve flow/direction control valve 8 between the function of supplying the hydraulic fluid to the option hydraulic actuator 14 and the function as the center bypass cut valve.

Second Embodiment

A second embodiment of the hydraulic system for a work machine according to the present invention will be described below with reference to FIGS. 10 and 11.

Figure 10:
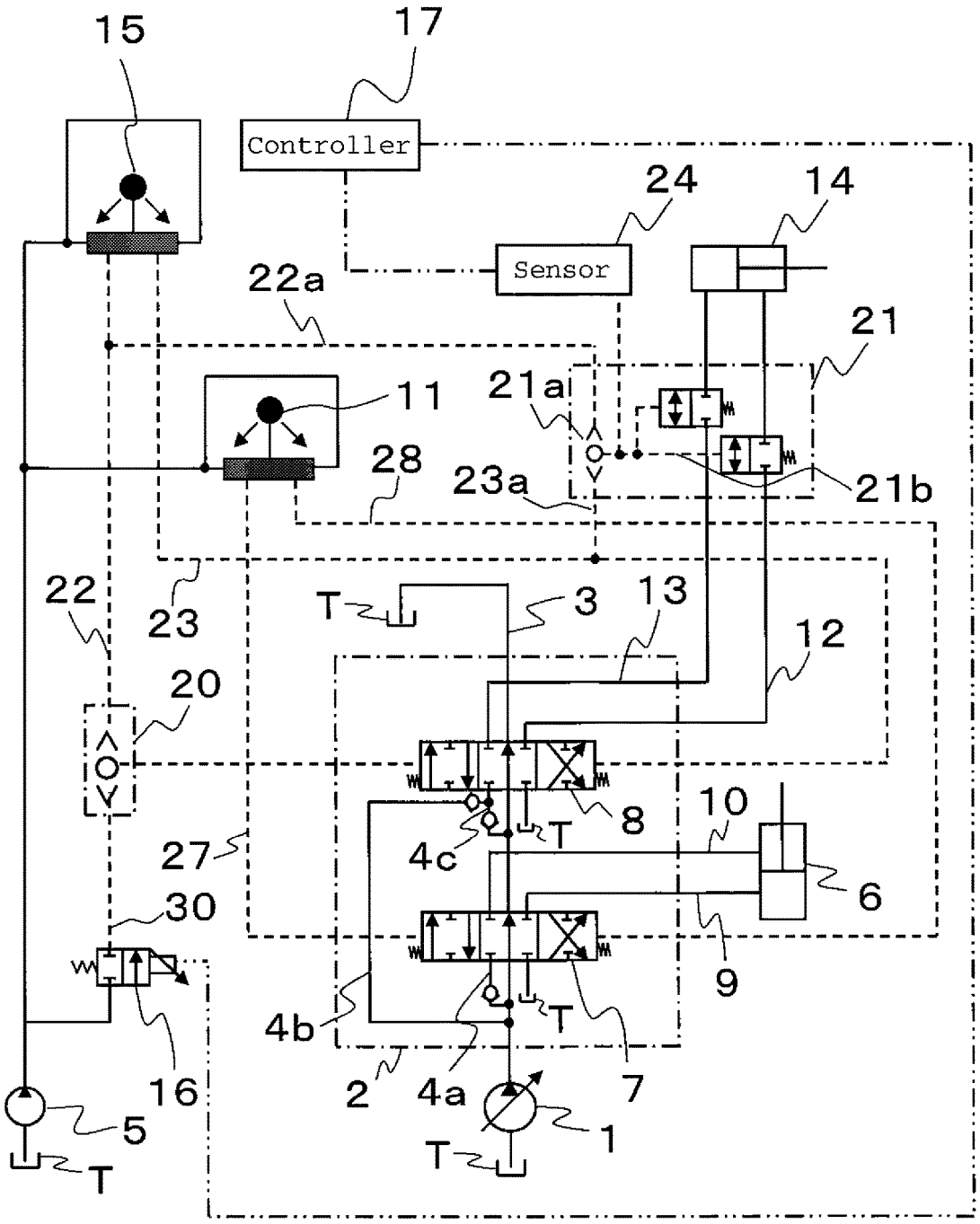
FIG. 10 is a configuration diagram showing the outline of a second embodiment of the hydraulic system for a work machine according to the present invention.

FIG. 10 is a configuration diagram showing the outline of the second embodiment of the hydraulic system for a work machine according to the present invention.

As shown in FIG. 10, the hydraulic system for a work machine according to the second embodiment of the present invention includes a pressure sensor 24 instead of the switch 26 and the monitor 19 in the hydraulic system for a work machine according to the first embodiment shown in FIG. 3. The pressure sensor 24 is used for detecting the magnitude of the pilot pressure in a hydraulic line 21*b* that supplies the hydraulic fluid to the option hydraulic actuator fluid cut valve 21 via a shuttle valve 21*a* that selects the pilot hydraulic fluid outputted to the pilot hydraulic line 22 or the pilot hydraulic fluid outputted to the pilot hydraulic line 23.

Further, the controller 17 outputs a command current to the solenoid valve 16 according to a detection signal from the pressure sensor 24.

Furthermore, the hydraulic system shown in FIG. 10 does not include the solenoid valve 18 arranged in the hydraulic line for supplying the hydraulic fluid to the option hydraulic actuator control lever 15 according to the value of the command current from the controller 17.

The rest of the configuration is roughly the same as that of the hydraulic system for a work machine shown in FIG. 3.

Operation

Next, the operation of the above-described hydraulic system for a work machine according to the second embodiment will be described below.

Option Attachment not Attached

In the hydraulic excavator shown in FIG. 1, when the mode in which not the option attachment but the bucket has been attached is selected, the controller 17 outputs a command current corresponding to the operation amount of the actuator control lever 11 to the solenoid valve 16. By the input of the command current, the opening area of the solenoid valve 16 is controlled and the center bypass opening area of the reserve flow/direction control valve 8 is also controlled. Since no option actuator has been attached, the option hydraulic actuator control lever 15 is normally not operated. Thus, no pressure rise occurs in the pilot hydraulic line 22 or 23, the option hydraulic actuator fluid cut valve 21 remains at the closed position, and the supply of the hydraulic fluid to the second actuator lines 12 and 13 is inhibited.

Accordingly, when the operator in the cab 103 operates the actuator control lever 11, the flow/direction control valve 7 operates according to the operation amount of the actuator control lever 11 and the hydraulic fluid delivered from the hydraulic pump 1 is supplied to the hydraulic actuator 6. In this case, the reserve flow/direction control valve 8 operates and the opening area for the hydraulic line for the hydraulic fluid delivered from the hydraulic pump 1 and flowing toward the tank T via the center bypass line 3 becomes equal to the composite opening area of the flow/direction control valves 7 and 8 and is controlled to be smaller than that in cases where only the flow/direction control valve 7 operates.

Option Attachment Attached and not Used

In the hydraulic excavator shown in FIG. 1, when the mode in which not the bucket but the option attachment has been attached is selected, the controller 17 continuously monitors the detection value of the pressure sensor 24. When it is judged from the detection value of the pressure sensor 24 that the option attachment is not being used, that is, the option hydraulic actuator control lever 15 is not being operated and the pilot hydraulic fluid is being outputted to neither the pilot hydraulic line 22 nor 23, the controller 17 outputs a command current corresponding to the operation amount of the actuator control lever 11 to the solenoid valve 16. By the input of the command current, the opening area of the solenoid valve 16 is controlled and the center bypass opening area of the reserve flow/direction control valve 8 is also controlled.

Accordingly, the reserve flow/direction control valve 8 operates and the opening area for the hydraulic line for the hydraulic fluid delivered from the hydraulic pump 1 and flowing toward the tank T via the center bypass line 3 becomes equal to the composite opening area of the flow/direction control valves 7 and 8 and is controlled to be smaller than that in cases where only the flow/direction control valve 7 operates.

Further, since no pressure rise occurs in the pilot hydraulic line 22 or 23, the option hydraulic actuator fluid cut valve 21 remains at the closed position, no hydraulic fluid is supplied to the second actuator line 12 or 13, and the option hydraulic actuator 14 is supplied with no hydraulic fluid.

Option Attachment Attached and Used

Similarly to the case where the option attachment has been attached but is not used, the controller 17 continuously monitors the detection value of the pressure sensor 24. When it is judged from the detection value of the pressure sensor 24 that the option attachment is being used, that is, the option hydraulic actuator control lever 15 is being operated and the pilot hydraulic fluid is being outputted to either the pilot hydraulic line 22 or 23, the controller 17 outputs no command current to the solenoid valve 16.

Accordingly, the solenoid valve 16 is positioned at the closed position, the pilot hydraulic fluid supplied to the pilot hydraulic line 22 flows through the shuttle valve 20 and is supplied to a pressure-receiving part of the reserve flow/direction control valve 8, the pilot hydraulic fluid supplied to the pilot hydraulic line 23 is supplied to the other pressure-receiving part of the reserve flow/direction control valve 8, the reserve flow/direction control valve 8 operates as a valve for controlling the flow rate and the direction of the hydraulic fluid supplied to the option hydraulic actuator 14, and the option attachment operates.

Effect

As described above, also in the hydraulic system for a work machine according to the second embodiment shown in FIG. 10, the function of the reserve flow/direction control valve 8 is switched between the function of supplying the hydraulic fluid to the option hydraulic actuator 14 and the function as the center bypass cut valve based on the operation on the option hydraulic actuator control lever 15, and consequently, effects similar to those of the hydraulic system for a work machine according to the first embodiment shown in FIG. 3 are achieved.

Further, in this embodiment, the hydraulic system is equipped with the pressure sensor 24 and the function of the reserve flow/direction control valve 8 is switched based on the operation on the option hydraulic actuator control lever 15. Accordingly, components such as the switch 26 and the solenoid valve 18 in the hydraulic system for a work machine according to the first embodiment shown in FIG. 3 become unnecessary, the circuit configuration is simplified, and a hydraulic system at a lower cost can be implemented.

Furthermore, since the function of the reserve flow/direction control valve 8 is switched based on the operation on the option hydraulic actuator control lever 15, the need of operating the switch 26 as in the first embodiment is eliminated and the operation is simplified.

Another Mode

The hydraulic system for a work machine according to this embodiment is not limited to the above-described configuration. In the following, the outline of another mode of the second embodiment of the hydraulic system for a work machine according to the present invention will be described with reference to FIG. 11.

Figure 11:
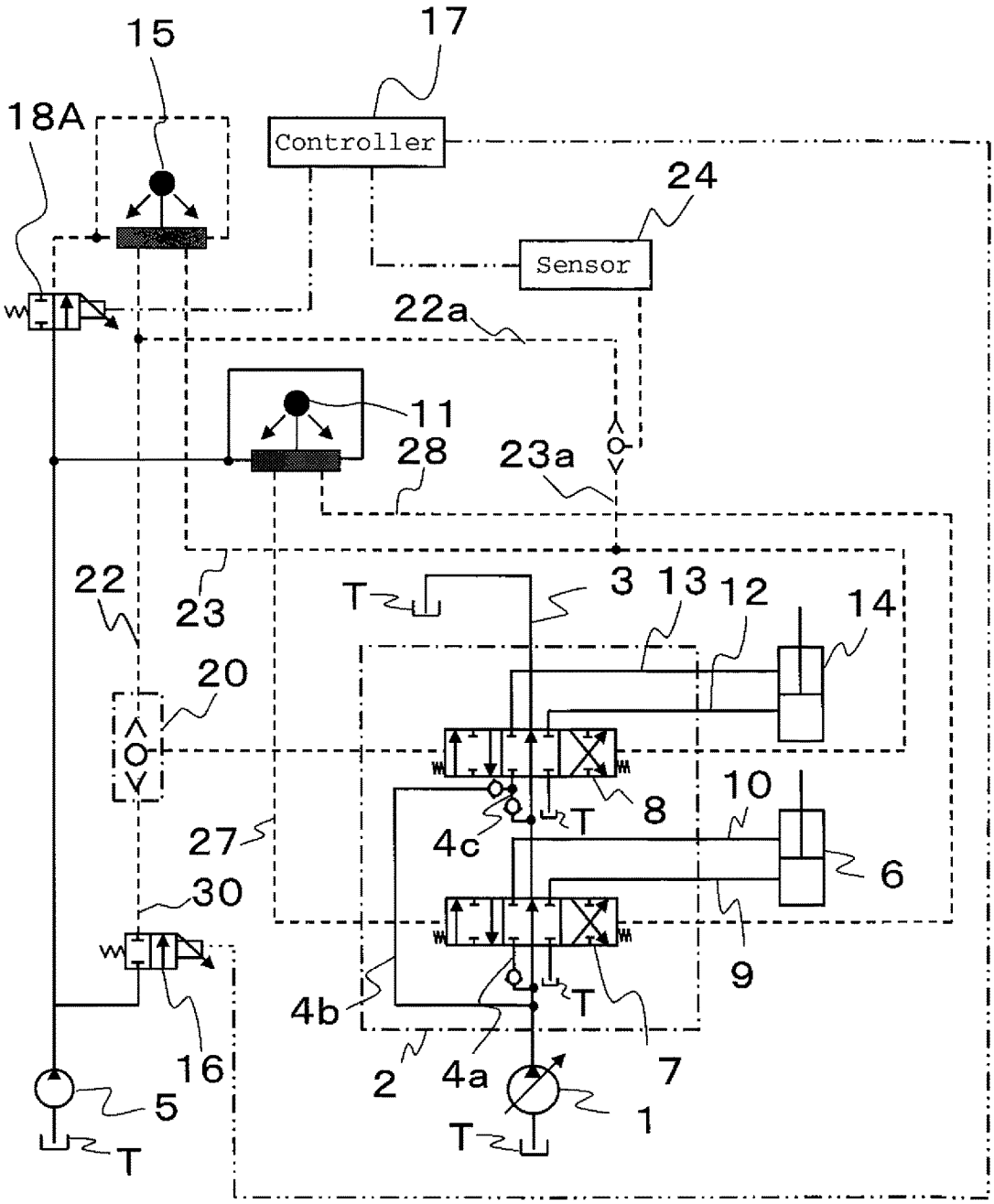
FIG. 11 is a configuration diagram showing another example of the outline of the second embodiment of the hydraulic system for a work machine according to the present invention.

FIG. 11 is a configuration diagram showing another example of the outline of the second embodiment of the hydraulic system for a work machine according to the present invention.

As shown in FIG. 11, the hydraulic system for a work machine according to another mode of the second embodiment of the present invention includes a solenoid valve 18A that is configured to supply the hydraulic fluid to the option hydraulic actuator control lever 15 according to the value of the command current from the controller 17 in cases where an option attachment has been attached and is operated in the hydraulic system for a work machine according to the second embodiment shown in FIG. 9.

Further, the hydraulic system shown in FIG. 11 does not include the option hydraulic actuator fluid cut valve 21.

The rest of the configuration is roughly the same as that of the hydraulic system for a work machine shown in FIG. 10.

Operation

Next, the operation of the above-described hydraulic system for a work machine according to another mode of the second embodiment will be described below.

Option Attachment not Attached

In the hydraulic excavator shown in FIG. 1, when the mode in which not the option attachment but the bucket has been attached is selected, the controller 17 outputs a command current corresponding to the operation amount of the actuator control lever 11 to the solenoid valve 16. By the input of the command current, the opening area of the solenoid valve 16 is controlled and the center bypass opening area of the reserve flow/direction control valve 8 is also controlled.

In contrast, the controller 17 outputs no command current to the solenoid valve 18A. Therefore, the solenoid valve 18A fully closes, no hydraulic fluid is supplied to the option hydraulic actuator control lever 15, and no pressure rise occurs in the pilot hydraulic line 22 or 23.

Accordingly, when the operator in the cab 103 operates the actuator control lever 11, the flow/direction control valve 7 operates according to the operation amount of the actuator control lever 11 and the hydraulic fluid delivered from the hydraulic pump 1 is supplied to the hydraulic actuator 6. In this case, the reserve flow/direction control valve 8 operates and the opening area for the hydraulic line for the hydraulic fluid delivered from the hydraulic pump 1 and flowing toward the tank T via the center bypass line 3 becomes equal to the composite opening area of the flow/direction control valves 7 and 8 and is controlled to be smaller than that in cases where only the flow/direction control valve 7 operates.

Option Attachment Attached and not Used

In the hydraulic excavator shown in FIG. 1, when the mode in which not the bucket but the option attachment has been attached is selected, the controller 17 outputs a command current to the solenoid valve 18A. Further, the controller 17 continuously monitors the detection value of the pressure sensor 24. When it is judged from the detection value of the pressure sensor 24 that the option attachment is not being used, that is, the option hydraulic actuator control lever 15 is not being operated and the pilot hydraulic fluid is being outputted to neither the pilot hydraulic line 22 nor 23, the controller 17 outputs a command current corresponding to the operation amount of the actuator control lever 11 to the solenoid valve 16.

Accordingly, the reserve flow/direction control valve 8 operates and the opening area for the hydraulic line for the hydraulic fluid delivered from the hydraulic pump 1 and flowing toward the tank T via the center bypass line 3 becomes equal to the composite opening area of the flow/direction control valves 7 and 8 and is controlled to be smaller than that in cases where only the flow/direction control valve 7 operates.

Option Attachment Attached and Used

Similarly to the case where the option attachment has been attached but is not used, the controller 17 outputs a command current to the solenoid valve 18A while continuously monitoring the detection value of the pressure sensor 24. When it is judged from the detection value of the pressure sensor 24 that the option attachment is being used, the controller 17 outputs no command current to the solenoid valve 16.

Accordingly, the solenoid valve 16 is positioned at the closed position, the pilot hydraulic fluid supplied to the pilot hydraulic line 22 flows through the shuttle valve 20 and is supplied to a pressure-receiving part of the reserve flow/direction control valve 8, the pilot hydraulic fluid supplied to the pilot hydraulic line 23 is supplied to the other pressure-receiving part of the reserve flow/direction control valve 8, the reserve flow/direction control valve 8 operates as a valve for controlling the flow rate and the direction of the hydraulic fluid supplied to the option hydraulic actuator 14, and the option attachment operates.

Effect

As described above, effects similar to those of the hydraulic system for a work machine according to the second embodiment shown in FIG. 10 are achieved also in the hydraulic system for a work machine according to another mode of the second embodiment shown in FIG. 11.

Further, since the hydraulic system in this mode does not include the option hydraulic actuator fluid cut valve 21, the circuit configuration becomes simple compared to the hydraulic system for a work machine shown in FIG. 10 and a hydraulic system at a still lower cost can be implemented.

Third Embodiment

A third embodiment of the hydraulic system for a work machine according to the present invention will be described below with reference to FIG. 12.

Figure 12:
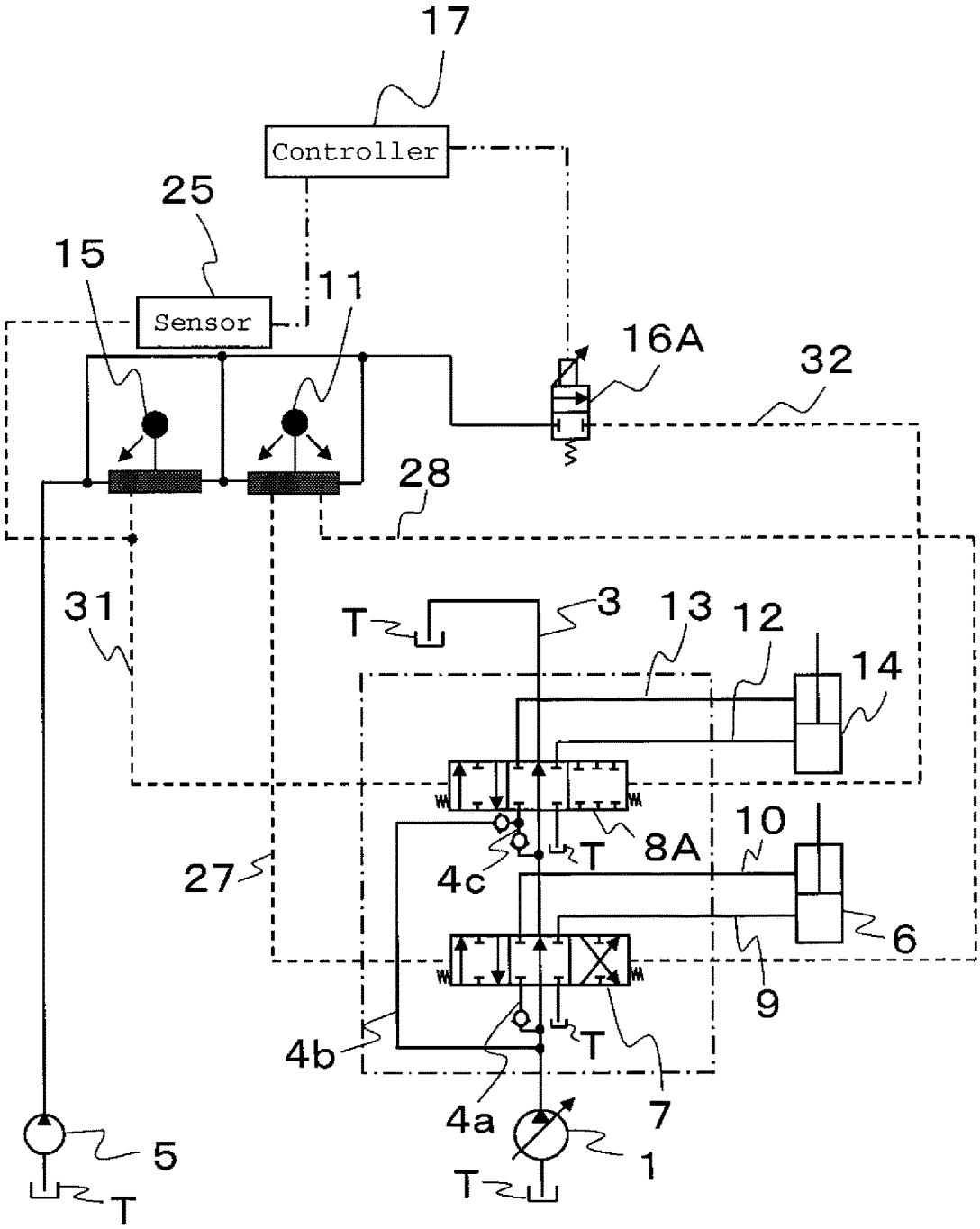
FIG. 12 is a configuration diagram showing the outline of a third embodiment of the hydraulic system for a work machine according to the present invention.

FIG. 12 is a configuration diagram showing the outline of the third embodiment of the hydraulic system for a work machine according to the present invention.

As shown in FIG. 12, the third embodiment of the hydraulic system for a work machine according to the present invention is provided with a reserve flow/direction control valve 8A instead of the reserve flow/direction control valve 8 for controlling the flow rate and the direction of the hydraulic fluid supplied from the hydraulic pump 1 to the option hydraulic actuator 14.

The reserve flow/direction control valve 8A at its neutral position blocks the second actuator lines 12 and 13 and thereby returns the hydraulic fluid delivered from the hydraulic pump 1 to the tank T. When the reserve flow/direction control valve 8A is operated as the center bypass cut valve, the reserve flow/direction control valve 8A blocks all of the center bypass line 3 and the second actuator lines 12 and 13. Further, when the option hydraulic actuator 14 is operated, the reserve flow/direction control valve 8A blocks the center bypass line 3, connects the second actuator line 13 to the hydraulic input line 4*c* and thereby supplies the hydraulic fluid delivered from the hydraulic pump 1 to the rod-side cylinder chamber of the option hydraulic actuator 14, and connects the second actuator line 12 to the tank T and thereby returns the hydraulic fluid discharged from the bottom-side cylinder chamber of the option hydraulic actuator 14 to the tank T.

The hydraulic system shown in FIG. 12 further includes a pilot hydraulic line 31 that inputs the pilot hydraulic fluid outputted from the option hydraulic actuator control lever 15 to one pressure-receiving chamber of the reserve flow/direction control valve 8 so as to make the reserve flow/direction control valve 8A operate as a flow/direction control valve when the option hydraulic actuator control lever 15 is operated.

Connected to the other pressure-receiving chamber of the reserve flow/direction control valve 8A is a pilot hydraulic line 32 for inputting the pilot hydraulic fluid decompressed by a solenoid valve 16A according to the value of a command current from the controller 17 to the pressure-receiving chamber in order to make the reserve flow/direction control valve 8A operate as the center bypass cut valve.

The hydraulic system shown in FIG. 12 further includes a pressure sensor 25 for detecting the magnitude of the pilot pressure in the pilot hydraulic line 31. The controller 17 outputs the command current to the solenoid valve 16A according to a detection signal from the pressure sensor 25.

The rest of the configuration is roughly the same as that of the hydraulic system for a work machine shown in FIG. 3.

Operation

Next, the operation of the above-described hydraulic system for a work machine according to the third embodiment will be described below.

Option Attachment not Attached

In the hydraulic excavator shown in FIG. 1, when the mode in which not the option attachment but the bucket has been attached is selected, the controller 17 outputs a command current corresponding to the operation amount of the actuator control lever 11 to the solenoid valve 16A. By the input of the command current, the opening area of the solenoid valve 16A is controlled and the pilot hydraulic fluid delivered from the pilot pump 5 and decompressed by the solenoid valve 16A is supplied to one pressure-receiving part of the reserve flow/direction control valve 8A via the pilot hydraulic line 32. Accordingly, the center bypass opening area of the reserve flow/direction control valve 8A is controlled (second position) and the opening area for the hydraulic line for the hydraulic fluid delivered from the hydraulic pump 1 and flowing toward the tank T via the center bypass line 3 becomes equal to the composite opening area of the flow/direction control valves 7 and 8A and is controlled to be smaller than that in cases where only the flow/direction control valve 7 operates.

Option Attachment Attached and not Used

In the hydraulic excavator shown in FIG. 1, when the mode in which not the bucket but the option attachment has been attached is selected, the controller 17 continuously monitors the detection value of the pressure sensor 25. When it is judged from the detection value of the pressure sensor 25 that the option hydraulic actuator 14 is not being used, the controller 17 outputs a command current corresponding to the operation amount of the actuator control lever 11 to the solenoid valve 16A. Accordingly, the center bypass opening area of the reserve flow/direction control valve 8A is controlled (second position) and the opening area for the hydraulic line for the hydraulic fluid delivered from the hydraulic pump 1 and flowing toward the tank T via the center bypass line 3 becomes equal to the composite opening area of the flow/direction control valves 7 and 8A and is controlled to be smaller than that in cases where only the flow/direction control valve 7 operates.

Option Attachment Attached and Used

Similarly, the controller 17 continuously monitors the detection value of the pressure sensor 25. When it is judged from the detection value of the pressure sensor 25 that the option attachment is being used, that is, the option hydraulic actuator control lever 15 is being operated and the pilot hydraulic fluid is being outputted to the pilot hydraulic line 31, the controller 17 outputs no command current to the solenoid valve 16A.

Accordingly, the solenoid valve 16A is positioned at the closed position, no pilot hydraulic fluid is supplied to the pilot hydraulic line 31, pilot pressure corresponding to the operation amount of the option hydraulic actuator control lever 15 is supplied to a pressure-receiving part of the reserve flow/direction control valve 8A via the pilot hydraulic line 31, and the reserve flow/direction control valve 8A operates as a flow/direction control valve for causing the option hydraulic actuator 14 to operate (first position).

Effect

As described above, also in the hydraulic system for a work machine according to the third embodiment shown in FIG. 12, the function of the reserve flow/direction control valve 8A is switched between the function of supplying the hydraulic fluid to the option hydraulic actuator 14 and the function as the center bypass cut valve based on the operation on the option hydraulic actuator control lever 15, and consequently, effects similar to those of the hydraulic systems according to the first and second embodiments shown respectively in FIGS. 3 and 9 are achieved.

According to this embodiment, a hydraulic system suitable for a mode in which the hydraulic fluid is supplied only to the rod-side cylinder chamber of the option hydraulic actuator 14 can be implemented.

Other Examples

It should be noted that the present invention is not to be restricted to the embodiments described above and a variety of modifications and applications are possible.

For example, while the above description has been given by using a hydraulic excavator as an example of the work machine, the work machine in the present invention is not restricted to hydraulic excavators.

DESCRIPTION OF REFERENCE CHARACTERS

1 hydraulic pump
2 control valve
3 center bypass line
4 hydraulic parallel line
4*a*, 4*c* hydraulic input line
5 pilot pump
6 hydraulic actuator
7 flow/direction control valve
8, 8A reserve flow/direction control valve
9 first actuator line
10 first actuator line
11 actuator control lever
12 second actuator line
13 second actuator line
14 option hydraulic actuator
15 option hydraulic actuator control lever
16 solenoid valve
17 controller
18, 18A solenoid valve
19 monitor (state display device)
20, 21*a* shuttle valve
21 option hydraulic actuator fluid cut valve
21*b*, 22, 23, 27, 28, 30, 31, 32 hydraulic line
22*a*, 23*a* hydraulic line
24, 25 pressure sensor
26 switch
101 track structure
102 swing structure
103 cab
104 boom
105 boom cylinder
106 arm
107 arm cylinder
108 link mechanism
109 crusher
110 attachment cylinder
120 base frame
122 fixed jaw
124 movable jaw
126 rotary shaft
T tank

The invention claimed is:

1. A hydraulic system for a work machine comprising:

a hydraulic pump;

a hydraulic actuator driven by hydraulic fluid delivered from the hydraulic pump;

a flow/direction control valve of center bypass type that controls a flow of the hydraulic fluid supplied from the hydraulic pump to the hydraulic actuator;

a reserve flow/direction control valve of the center bypass type arranged at a position in a center bypass line extending through the flow/direction control valve and on a downstream side of the flow/direction control valve, the reserve flow/direction control valve controlling the flow of the hydraulic fluid supplied from the hydraulic pump to an option hydraulic actuator when the option hydraulic actuator is used; and a switching control device that makes the reserve flow/direction control valve operate as a valve for controlling the flow of the hydraulic fluid supplied to the option hydraulic actuator when the option hydraulic actuator is operated, while making the reserve flow/direction control valve operate as a center bypass cut valve when the option hydraulic actuator is not operated, wherein:

the switching control device further comprises a sensor configured to detect that the hydraulic system is in a state not for making the reserve flow/direction control valve operate as a flow/direction control valve for the option hydraulic actuator, and the switching control device performs control configured to switch the operation of the reserve flow/direction control valve based on a detection signal outputted from the sensor.

2. The hydraulic system for a work machine according to claim 1, further comprising a switching valve arranged in an actuator hydraulic line for supplying the hydraulic fluid from the reserve flow/direction control valve to the option hydraulic actuator, wherein the switching control device performs the control so as to close the switching valve and thereby block the hydraulic line when the reserve flow/direction control valve is made to operate as the center bypass cut valve.

* * * * *